US005970761A

United States Patent [19]

Eden, Jr.

[11] Patent Number: 5,970,761

[45] Date of Patent: Oct. 26, 1999

[54] LOCK SYSTEM WITH KEY TRAPPING

[75] Inventor: Charles W. Eden, Jr., Plantsville, Conn.

[73] Assignee: International Security Products, Inc., Southington, Conn.

[21] Appl. No.: 09/123,743

[22] Filed: Jul. 27, 1998

Related U.S. Application Data

[62] Division of application No. 08/683,848, Jul. 19, 1996, Pat. No. 5,819,567.

[51] Int. Cl.[6] ..... D05B 11/06

[52] U.S. Cl. ..... 70/390; 70/389; 70/406; 70/419

[58] Field of Search ..... 70/393, 409, 405, 70/406, 402, 394, 495, 496

[56] References Cited

U.S. PATENT DOCUMENTS

| | | | |
|---|---|---|---|
| 375,540 | 12/1887 | Donahue | 70/407 |
| 915,317 | 3/1909 | Thomas . | |
| 1,403,472 | 1/1922 | Horak | 70/407 |
| 2,151,245 | 3/1939 | Swilens . | |
| 3,035,433 | 5/1962 | Testa . | |
| 3,352,134 | 11/1967 | Lett | 70/407 |
| 3,531,959 | 10/1970 | Weber . | |
| 3,742,744 | 7/1973 | Lumme . | |
| 4,085,601 | 4/1978 | Sauder . | |
| 4,222,252 | 9/1980 | Tietz . | |
| 4,325,242 | 4/1982 | Tietz . | |
| 4,377,082 | 3/1983 | Wolter . | |
| 4,377,940 | 3/1983 | Hucknall . | |
| 4,393,673 | 7/1983 | Widen . | |
| 4,412,787 | 11/1983 | Prunbauer et al. . | |
| 4,608,842 | 9/1986 | Tietz . | |
| 4,638,651 | 1/1987 | Surko, Jr. . | |
| 4,787,225 | 11/1988 | Hauser et al. . | |
| 4,869,085 | 9/1989 | Meissner . | |
| 5,136,869 | 8/1992 | Best | 70/406 |
| 5,493,884 | 2/1996 | Hinz et al. . | |
| 5,617,750 | 4/1997 | Preddy | 70/495 |

FOREIGN PATENT DOCUMENTS

| | | | |
|---|---|---|---|
| 22910886 | 10/1980 | Germany . | |
| 2931653 | 2/1981 | Germany . | |
| 3136314 | 3/1983 | Germany | 70/406 |
| 3643188 | 6/1988 | Germany . | |
| 4035934 | 6/1991 | Germany . | |

*Primary Examiner*—Suzanne Dino Barrett
*Assistant Examiner*—Teri Pham
*Attorney, Agent, or Firm*—Alix, Yale & Ristas, LLP

[57] ABSTRACT

A novel lock system utilizes a cylinder lock and a companion key with a projection extending from one side thereof to improve security. The cylinder lock comprises a shell, a core which is rotatably mounted within the shell and a plurality of pin tumbler stacks normally prevent movement between the shell member and the core. Shear lines are defined between the shell and the core, and also within each tumbler stack. The core also includes an outer surface, a longitudinal keyway and a cut-out which is normally offset from, but alignable with, at least one of the tumbler stacks. A plate member is disposed within the cut-out for movement between a first position, wherein the plate member acts as an extension of the core surface to prevent a tumbler stack from entering the cut-out and a second position, wherein the plate member does not prevent a tumbler stack from entering the cut-out. Upon insertion of an authorized key, the key bitting will appropriately align the tumbler shear lines with the shell/core shear line, and the key projection will urge the plate from the second position to the first position and thereby permit the core to rotate to an unlocked position. Upon insertion of a properly bitted key which does not possess an appropriate key projection, however, only partial core rotation is permitted whereupon a tumbler stack enters the cut-out to thereby render the lock inoperable and trap the unauthorized key within the keyway.

9 Claims, 6 Drawing Sheets

LOCK SYSTEM WITH KEY TRAPPING

This is a divisional application of application Ser. No. 08/683,848, filed Jul. 19, 1996, U.S. Pat. No. 5,819,567.

BACKGROUND OF THE INVENTION

1. Field of the Invention

The present invention relates to enhancements in the providing of security to areas through which access is afforded by means of a door and, particularly, to increasing the difficulty of obtaining an unauthorized key for operation of a lock installed in such a door. More specifically, this invention is directed to mechanical locking systems and, especially, to a novel lock and key which, in combination, provide access control, the lock "trapping" any other key which is employed in an attempt to defeat the lock. Accordingly, the general objects of the present invention are to provide novel and improved methods and apparatus of such character.

2. Description of the Prior Art

Mechanical locks which employ one or more linear arrays of pin tumbler stacks are, of course, well known in the art. The pin tumbler stacks of such locks are radially displaceable, with respect to the axis of rotation of a plug or core, in response to insertion of a key in a keyway provided in the core. The pin tumbler stacks comprise at least an upper or driver pin, which is spring biased toward the axis of core rotation, and a driven or bottom pin. A properly bitted key will cause pin tumbler stack displacement which, typically, causes the interface between the axially aligned driver and bottom pins to be coincident with a shear line defined by the core outer circumference. Thus, a properly bitted key will permit the core, with the bottom pins, to rotate within a shell. Core rotation will, through the action of a cam or tailpiece connected to the core, cause operation of a latch mechanism.

Locks of the type generally discussed above are known in the art as "cylinder" locks. The most common manner of defeating a cylinder lock consists of "manufacture" of an unauthorized key. It is believed fair to state that it is not possible to ensure against defeat simply by designing an intricate keyway and/or through the use of various arrangements of pin tumbler stacks. Thus, there has been a long-standing desire for a lock which affords increased security and, particularly, a lock which will "trap" any unauthorized key, particularly a partly formed key which is being "patterned" in an attempt to defeat the lock. In addition to key trapping, a high level of security also dictates a unique combination of a lock and key, i.e., a lock system, which affords the lock manufacturer the ability to exercise key control by means of being the sole source of the key portion of the system.

SUMMARY OF THE INVENTION

The present invention overcomes the above-briefly discussed and other deficiencies and disadvantages of the prior art and, in so doing, provides a novel lock system which is characterized by the use of a key having a unique security feature and which will "trap", i.e., mechanically capture in the keyway, any incorrect key which, lacking the unique security feature, is nevertheless bitted so as to displace the pin tumblers to a position which will enable rotation of the core relative to the shell.

A lock system in accordance with the invention includes a cylinder lock with a core in which, at the longitudinal position of at least one pin tumbler stack, is provided with a cut-out which is generally in the shape of a circular segment. With the lock in the locked state, i.e., prior to rotation of the core relative to the shell, this circular segment will be out of alignment with the pin tumbler stack. The cut-out is in communication with the keyway via an opening provided in a side of the keyway. A plate member or segment is inserted in the cut-out, the plate member being sized and shaped so as to be capable of limited movement within the cut-out and relative to the core, such movement being guided by the internal diameter of the shell. Movement of the plate member may be produced by a unique security feature, namely a camming projection, provided on the side of an authorized key. This camming projection extends through the opening in the keyway side. This camming projection is sized and shaped to protrude outwardly beyond the plane of the side of the blank from which the key was formed and into the circular sector. The plate member, when caused to move along a path defined by the shell internal diameter in response to contact with a camming projection on an authorized key, will function as an extension of the core and will present an edge which generally corresponds to the shear line. Thus, with an authorized key in the keyway, the core will appear to be uninterrupted to the driver pin of a pin tumbler stack at the location of the cut-out. However, in the case of an unauthorized key, core rotation will cause the outer periphery of the plate member to be displaced below the shear line and, in part, to define an opening into which the driver pin will move once the core has been rotated relative to the shell sufficiently to fully register the pin tumbler chamber in the shell with the cut-out in the core. The driver pin will, accordingly, move radially toward the axis of core rotation so as to bridge the shear line and prevent further core rotation in either the clockwise or counter-clockwise direction. The lock will thus be rendered inoperable and the unauthorized key will be trapped in the keyway.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENT

Figure 1:
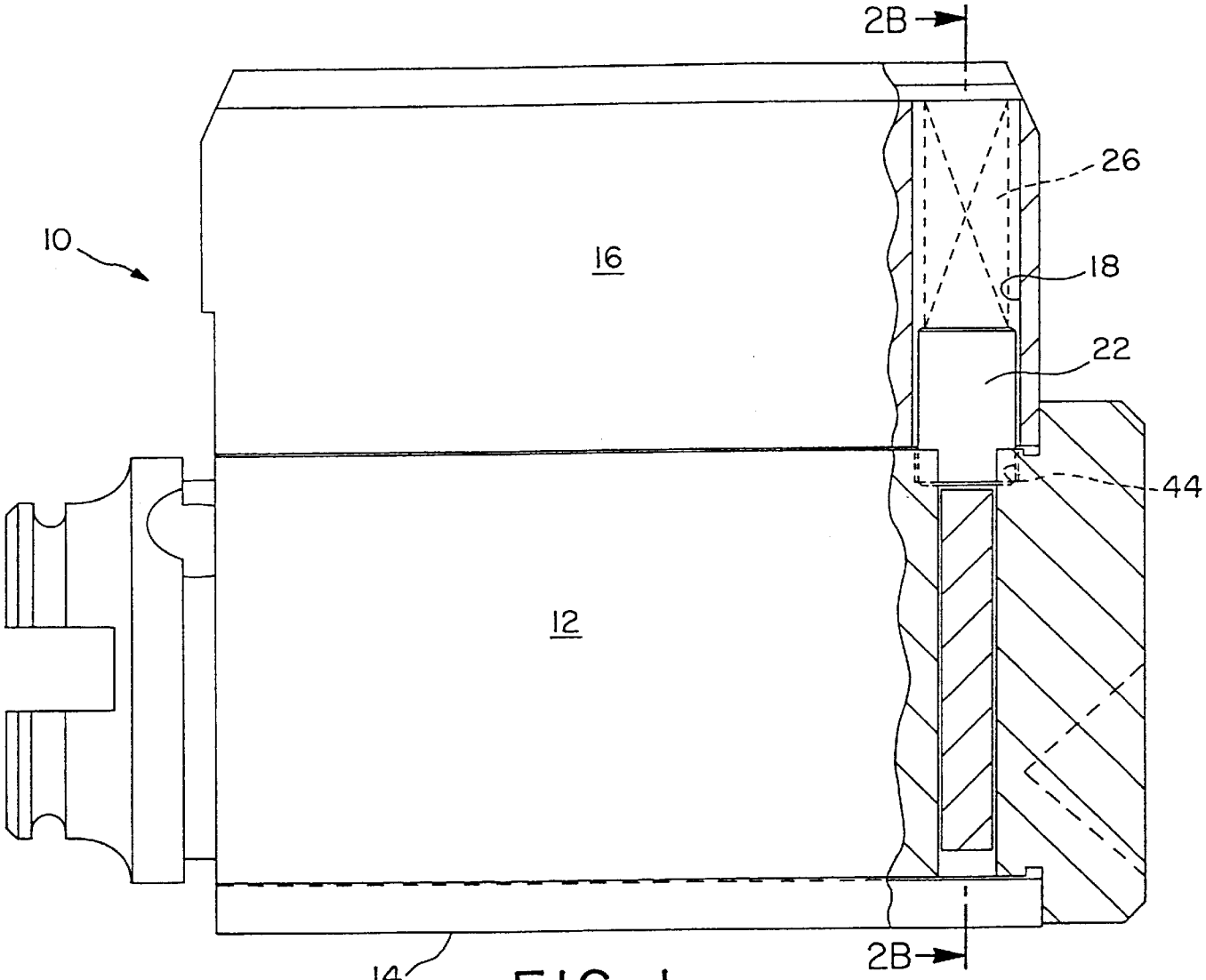
FIG. 1 is a side elevation view, partly in section, of a lock in accordance with the present invention.

With reference jointly to FIGS. 1–4, a cylinder lock in accordance with the present invention is indicated generally at 10. Lock 10 comprises a core 12 which may be rotated, about an axis of rotation, relative to a shell 14. Shell 14 includes an extension or bible 16. In the disclosed embodiment, a single linear array of pin chambers, such as chamber 18, are provided in bible 16. The pin chambers 18, with the lock in the locked state as depicted in FIGS. 2*a* and 36*a*, are in registration with pin chambers 20 in core 12. In the disclosed embodiment, pin tumbler stacks comprising an upper or driver pin 22 and a driven or bottom pin 24 are provided in the registered pin chambers. The driver pins 22 are resiliently biased, by means of compression springs 26, radially in the direction of the axis of rotation of core 12. A tailpiece or cam, not shown, will be connected to the end of core 12 disposed at the right as the lock is shown in FIG. 1. The tailpiece will be coupled to a latch mechanism or the like so that the lock may be employed to selectively prevent and permit access to a space on one side of a door in which the lock is installed.

The lock as described above is of conventional construction. It will thus be understood by those skilled in the art that the configuration and location of the pin chambers and pin tumbler stacks may be varied without departing from the invention. For example, there may be multiple arrays of pin chambers, radially offset from one another, and the stacks may include any number of pins.

Also in accordance with conventional construction, a keyway 28 (see FIG. 2*a*) is provided in core 12, the keyway defining a plane. In the disclosed embodiment, the axes of the pin chambers 18 lie in this plane. The keyway communicates with the pin chambers 20 in the core and has a unique profile, i.e., cross-section, as chosen by the lock manufacturer. A conventional keyway includes a plurality of wards which, in part, define the keyway cross-section. A key which will operate lock 10, i.e., a key which may be inserted in the keyway, must have a blade with side surfaces cut so as to be complementary with these wards. Thus, starting from a key blank with parallel sides, longitudinal cuts may be made so that the blade cross-section matches the keyway cross-section. Additionally, considering the lock depicted in the drawings as an example, the lock having a single linear array of pin tumbler stacks, one edge of the key blade must also be cut, i.e., bitted, such that, upon insertion of the key into the keyway, contact between the irregular upper edge of the key and the bottom pins will, as depicted in FIGS. 2 and 3, move the pin tumbler stacks against the bias of the springs 26 so as to place the interface between the driver and bottom pins at the shear line between the core 12 and shell 14. Thus, in a conventional cylinder lock, in order to permit relative rotation between the core and shell, the key blank must be provided with longitudinal cuts on the sides to define a profile which matches the keyway cross-section and a key blank having the correct profile must be cut on an edge in accordance with the lock combination defined by the variable length pins which define the individual pin tumbler stacks.

In accordance with the present invention, at the location of at least one of the pin tumbler stacks, a circular segment is cut out of core 12. This segment is defined by a wall 30 on core 12 which, with the exceptions to be discussed below, is straight and continuous between two points of intersection with the shear line. In the disclosed embodiment, the spacing between keyway 28 and wall 30 increases from a first end of the wall located adjacent the bottom of the keyway to an opposite end of wall 30 which is adjacent the outer end of a pin chamber 20 in core 12. An opening 32 in wall 30 provides communication between the keyway and the space formed by the circular segment cut-out. In the disclosed embodiment, the opening 32 is formed by a semi-circular groove which forms a portion of the keyway profile. Restated, in the region of the circular segment cut-out, the radius of the groove which in part defines the keyway exceeds the thickness of the wall separating the cut-out from the keyway, thus forming an opening 32 with arcuate side walls. The opening 32 is located at the opposite side, when compared to the pin tumbler chamber 20, of a plane which extends through the core axis of rotation and is transverse to the axis of chamber 20.

A movable plate member 34 having a shape which is similar to, but different from, the circular segment cut-out defined by wall 30 is inserted in the cut-out. Plate 34 has a first straight side 36 which faces wall 30. Side 36 is provided with a cam follower projection 38 which extends into opening 32. Plate 34 also has an arcuate side 40 which extends from a first end of side 36, the radius of side 40 being substantially the same as the radius of core 12. Arcuate side 40 terminates at, i.e., merges with a second side surface 42, which may either be straight or curved as shown, which extends to the second end of side 36, i.e., the end of side 36 which is disposed above the plane of the top of the keyway as the lock is depicted in FIGS. 2 and 3. The width of plate 34 is, as may best be seen from FIG. 1, less than the diameter of the pin chamber 18 in bible 16. Core 12 is provided with a blind hole or recess 44 which, in part, extends into wall 30. Hole 44 has a size and shape complementary to the lower end of a driver pin 22. The axis of hole 44 intersects the circular segment cut-out. Consequently, plate 34 extends into, and may effectively bridge, blind hole 44. Depending on the position of plate 34, access of pin 22 to hole 44 will either be permitted or blocked. The position of plate 34 is controlled in the manner to be described below.

Figure 5:
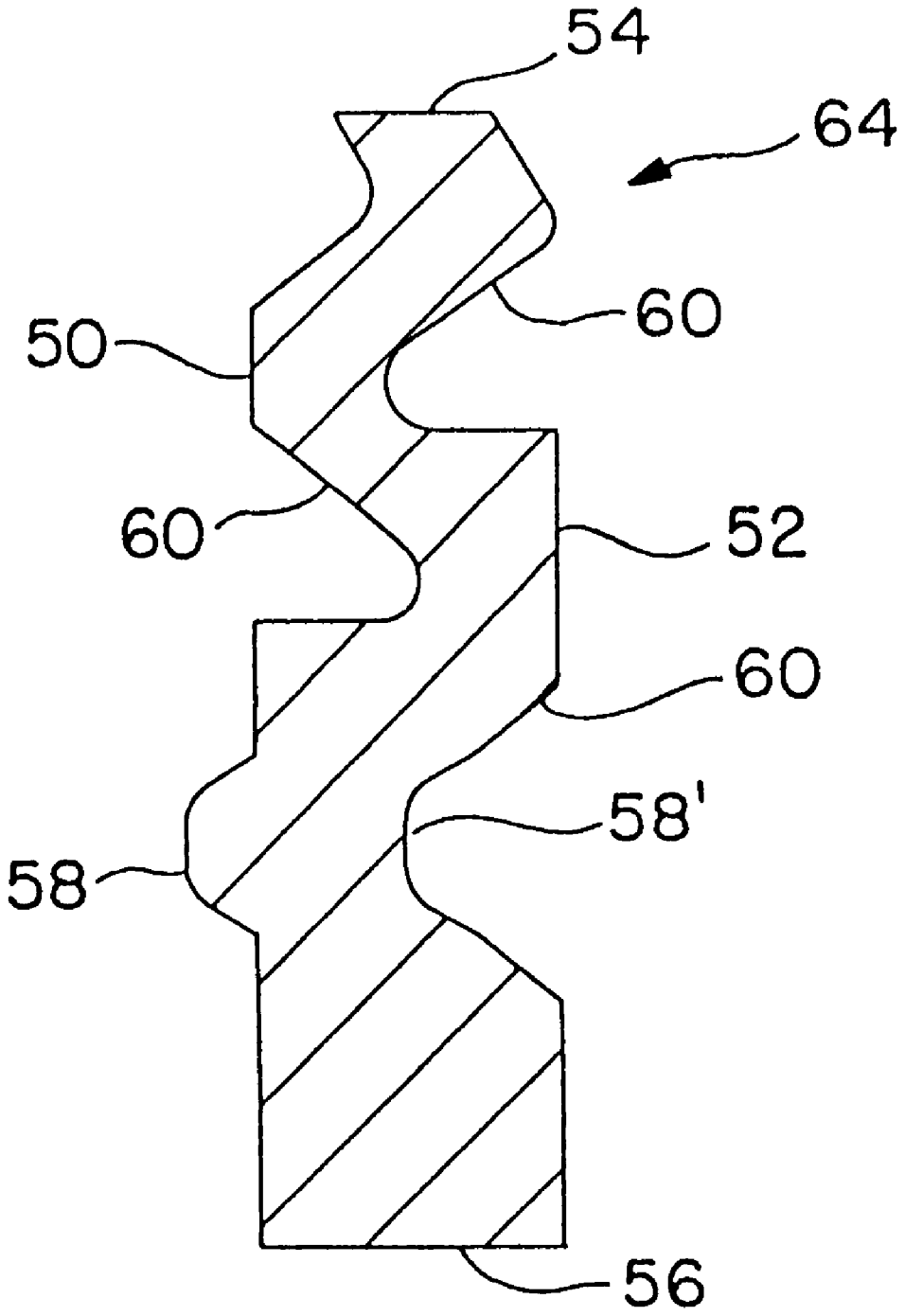
FIG. 5 is a cross-sectional view, taken along line 5—5 of FIG. 4*b*, of the key blank of FIGS. 4*a* and 4*b*.
Figure 6A:
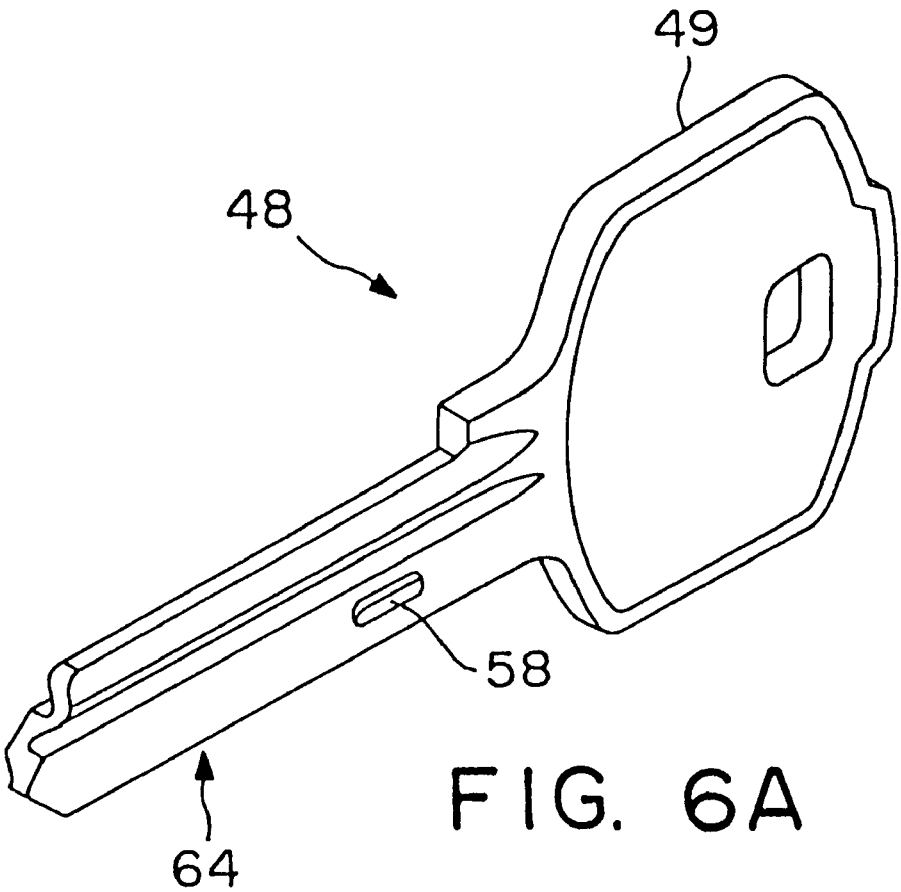
FIGS. 6*a* and 6*b* are perspective views of the key blank of FIGS. 4*a* and 4*b*.
Figure 6B:
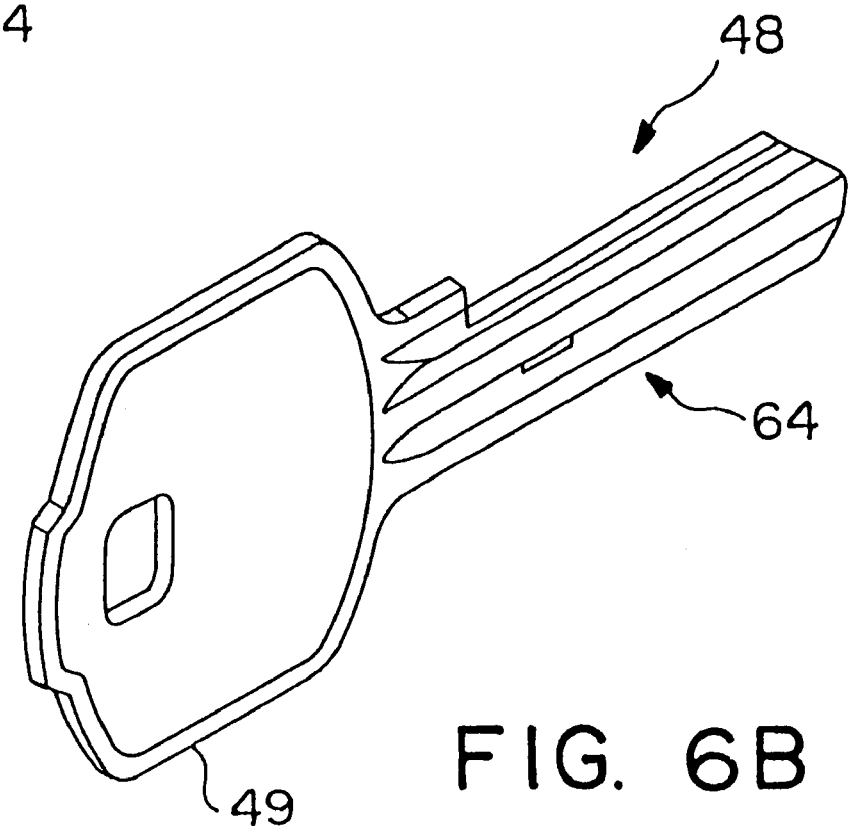

A key in accordance with the invention is indicated at 46 in FIG. 3. The blank from which key 46 was cut is indicated at 48 in FIGS. 4 and 6. The blade portion of key blank 48 indicated generally at 64, extends from a bow 49 and has a pair of opposite, planar sides 50 and 52, the spacing between the planes of sides 50 and 52 (before the key profile defining longitudinal cuts are made) defining the maximum blade width, and top and bottom edges 54 and 56. Where key blank 48 deviates from the prior art is in the provision of a camming projection 58 on side 50 of the blade. Camming projection 58 is preferably elongated, as may be seen from FIGS. 4*a* and 6*a*, and has a cross-section which is generally complementary to that of the groove which defines opening 32. A recess 58' is formed in the opposite side of blade 64 in registration with projection 58 as may be seen from FIGS. 4, 5 and 6. Recess 58' has a size and shape which is generally complementary to the size and shape of projection 58. Projection 58 is also located below the center line of the blade. Blank 48 will also be provided with longitudinal cuts 60, i.e., elongated machined grooves, in the side(s) of the blank as required by the wards in the keyway. A key for operation of lock 10 may be produced by cutting the top edge 54 of blank 48 to provide flats, i.e., the bitting, which will be in registration with the pin tumbler stacks with the key fully inserted in the keyway, these flats being at a "height" so as to displace the individual pin tumbler stacks as appropriate to satisfy the lock combination. A particularly unique feature of key blank 48 resides in the extension of projection 58 beyond the plane of side 50 as best seen from FIGS. 5 and 6*a*.

Figure 2B:
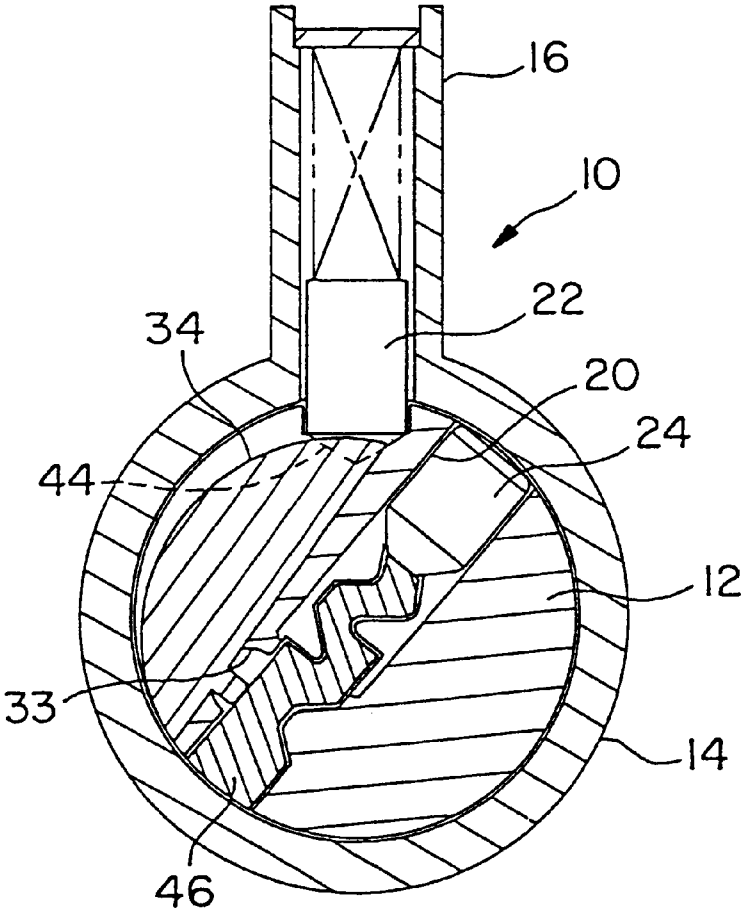
FIGS. 2*a* and 2*b* are, respectively, cross-sectional side elevation views of the lock of FIG. 1 depicting an attempt to operate the lock with an unauthorized key, FIG. 2*a* depicting key insertion and FIG. 2*b*, which is taken along line 2*b*—2*b* of FIG. 1, depicting partial rotation and key trapping.
Figure 2A:
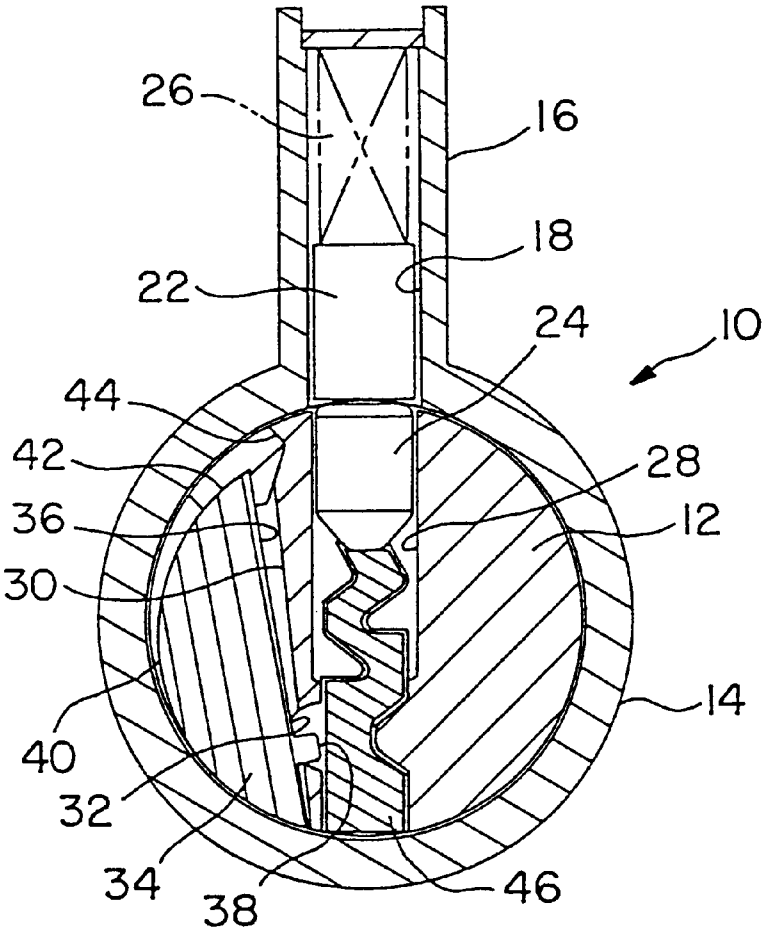

Referring to FIG. 2, insertion in keyway 28 of an unauthorized which satisfies the lock combination save for the camming projection 58 will displace all of the pin tumbler stacks to positions which will permit rotation of core 12 within shell 14. As the core is rotated in the clockwise direction, it will carry the plate member 34. After a relatively small degree of rotation, as depicted in FIG. 2*b*, the plate member will "flop" over so that the side 36 thereof abuts the wall 30, this "flopping" action resulting from either or both of interaction between spring biased driver pin 22 and plate 34 or the influence of gravity. When rotation continues to the point where blind hole 44 is in registration with pin chamber 18, the driver pin 22 will, under the influence of spring 26, be driven into blind hole 44 until it bottoms on the top, i.e., the side 42, of plate member 34. At this point, because driver pin 22 will bridge the shear line, further rotation of the core in either a clockwise or counter-clockwise direction, will be prevented. Additionally, because of the interaction between the immobilized bottom pins and the top edge of the key blade, the unauthorized key 66 will be trapped in the keyway, i.e., will not be removable.

Figure 3B:
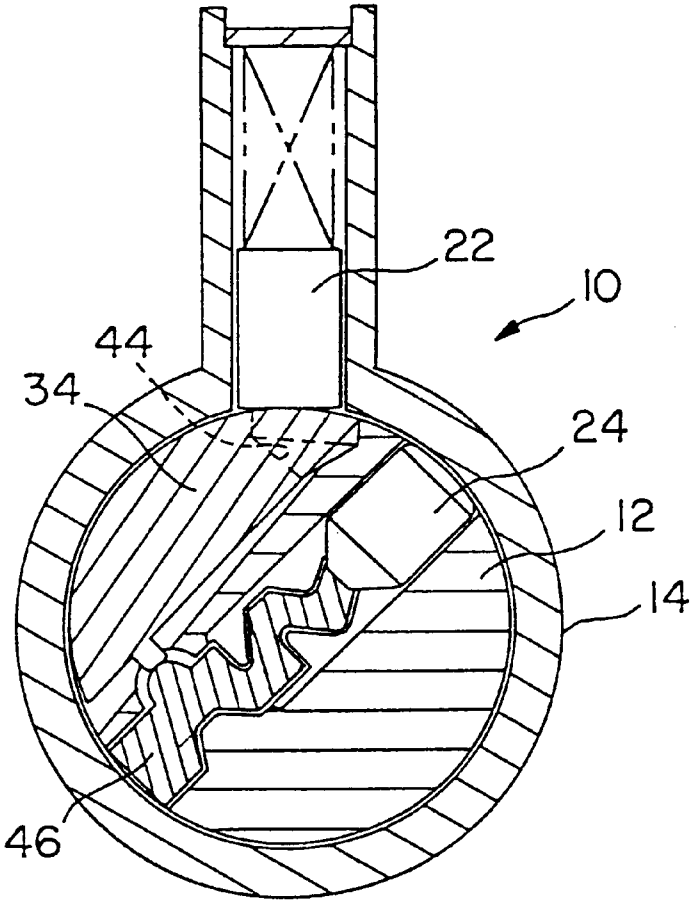
FIGS. 3*a* and 3*b* are views similar to FIGS. 2*a* and 2*b* but depicting operation of the lock with an authorized key.
Figure 3A:
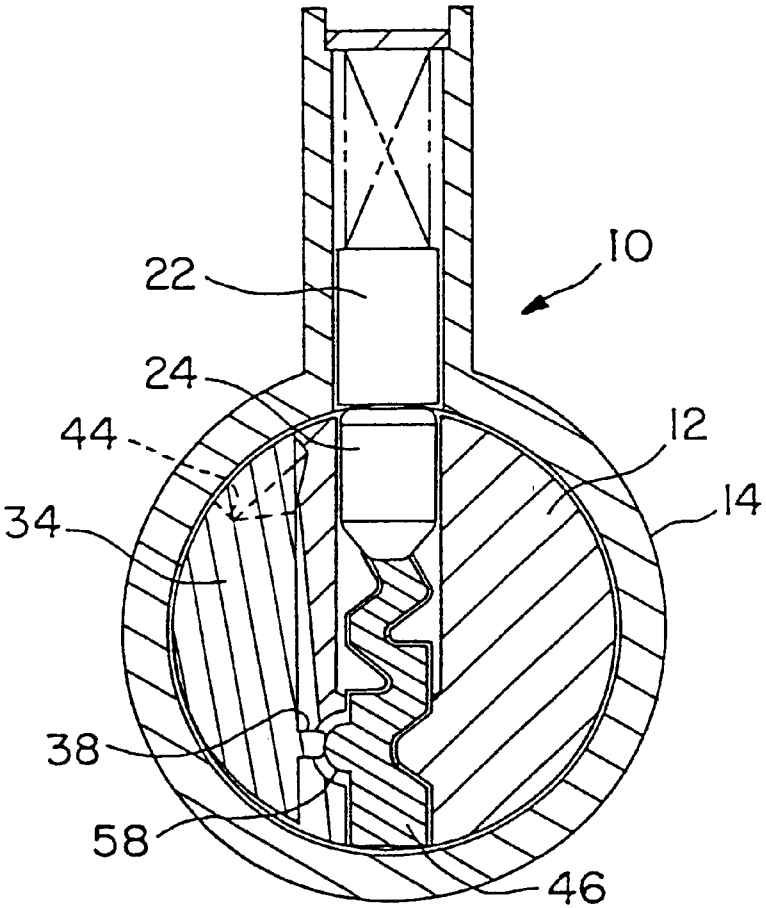
Figure 4A:
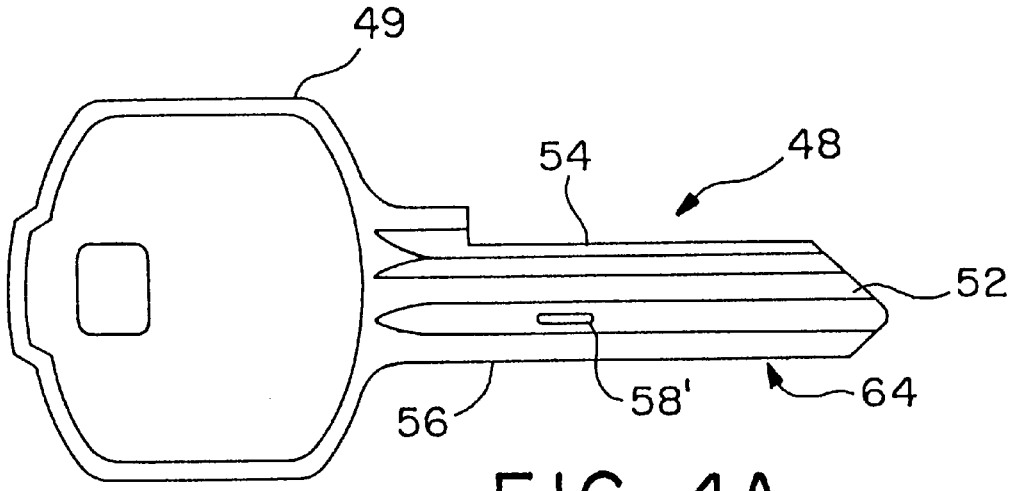
FIGS. 4*a* and 4*b* are respectively front elevation and rear elevation views of the key blank in accordance with the invention.
Figure 4B:
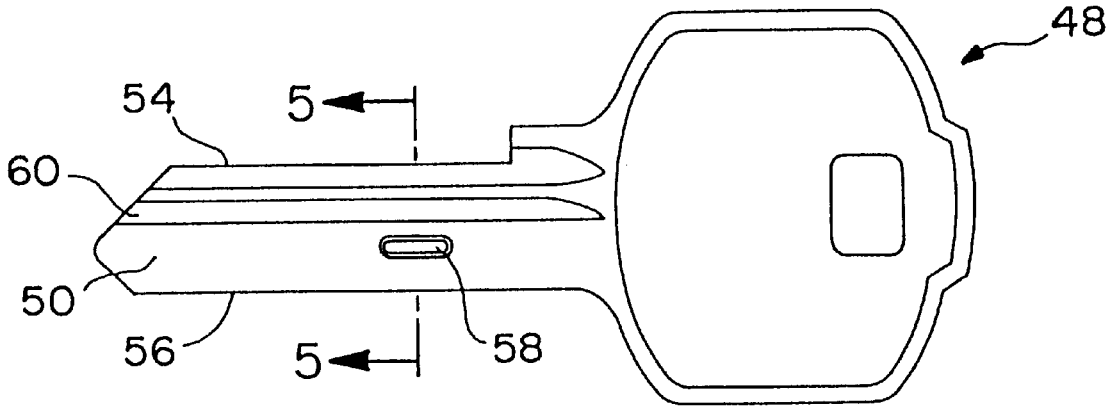

If the above-described trapping action is desired for both the clockwise and counter-clockwise directions of rotation of core 12 from the position of FIGS. 2*a* and 3*a*, a second plate member 34' (not shown) will be provided and a second camming projection will be formed on the side of the key blade oppositely disposed with respect to projection 58.

As may be seen from FIG. 3, the insertion of an authorized key in keyway 28 will result in the establishment of contact between camming projection 58 and the projection 38 on plate member 34. This contact will impart clockwise movement, relative to core 12, of the plate member 34, i.e., the projection 38 functions in the manner of a cam follower and, in so doing, drives the plate member 34 with which it is integral. This movement will be guided by the inner diameter of shell 14 and thus plate member 34 will be driven upwardly such that the junction of sides 36 and 42 is in an abutting relationship with the upper end of wall 30. This abutting relationship causes side 42 of the plate member to bridge blind hole 44. Accordingly, when the core 12 is rotated within shell 12, side 42 of plate 34 will initially prevent driver pin 22 from entering blind hole 44 to a significant degree and, as rotation of the core continues to the position shown in FIG. 3*b*, the arcuate side 40 will contact the bottom of driver pin 24 and cam driver pin against the bias of spring 26 so that rotation of the core to the unlocked position may be accomplished.

While a preferred embodiment has been described, various modifications and substitutions may be made thereto without departing from the spirit and scope of the invention. Accordingly, it is to be understood that the present invention has been described by way of illustration and not limitation.

What is claimed is:

1. A key blank for a key intended for use in cooperation with a cylinder lock having a rotatable core, the core of the lock including a keyway which extends inwardly from a first end of the core, the keyway having a pair of opposite sides which define a keyway cross-sectional profile, the core also defining a cut-out which extends to the keyway through one of the sides of the keyway in a region displaced from the first end of the core, the cylinder lock further having a plate movably mounted within the cut-out, the plate having a cam follower projection which extends into the keyway intermediate the ends thereof, said key blank comprising:

a bow;

a blade longitudinally extending from said bow to a blade tip, said blade having first and second side faces and a pair of oppositely disposed spaced edges which interconnect said side faces, at least one of said first and second side faces including longitudinally extending surfaces which define an irregular key blade cross-section whereby said blade may be longitudinally inserted into the keyway of the cooperating cylinder lock until said bow is juxtapositioned to the first end of the core of the cooperating cylinder lock, said first and second blade side faces being substantially parallel to one another prior to formation of said blade cross-section defining longitudinally extending surfaces, said parallel side faces respectively defining first and second planes; and at least one three dimensional camming projection extending outwardly beyond said first plane, said camming projection being longitudinally displaced from said bow and said blade tip and being positioned between said blade edges whereby said camming projection is adapted to intercept the cut-out in the side of the keyway of the cooperating cylinder lock, the surface of said camming projection which faces said blade tip being adapted to drivingly engage the cam follower which extends into the keyway from a side thereof whereby the cam follower projection of the movable plate of the cooperating cylinder lock may be caused to move outwardly with respect to the keyway of the cooperating cylinder lock in response to longitudinal insertion of said blade into the lock keyway.

2. A key blank for a key intended for use with a cooperating cylinder lock having a relatively movable member with a cam follower projection which extends into the keyway of the cylinder lock through a side thereof, said key blank comprising:

a bow;

an elongated blade extending from said bow and terminating at a blade tip, said blade having a longitudinal axis and a pair of oppositely disposed and spaced edges, the spacing between said edges defining the blade width, said blade further having first and second side faces which interconnect said edges, the spacing between said first and second side faces defining the blade thickness, said blade thickness being measured transversely with respect to said blade width and being substantially smaller than said width, said side faces each including at least a first elongated groove which extends substantially the length of said blade, a pair of substantially parallel planes being defined by portions of said side faces which do not include said elongated grooves, said planes defining the maximum thickness of said blade;

an elongated three dimensional camming projection on a first of said blade side faces in a region intermediate said bow and blade tip, said camming projection extending outwardly beyond the one of said parallel planes which is defined by said first side face, said camming projection being longitudinally displaced from said bow and said blade tip and having a length which is substantially less than the length of said blade, said camming projection having at least a first cam surface which faces said blade tip, said first cam surface being adapted to engage and deliver a force having a component directed transversely to said one plane to the cam follower projection which extends into the keyway of the cooperating cylinder lock through the side of the lock keyway which is adjacent to said blade first side face; and a recess in a second of said blade side faces, said recess being at least in part in registration with said camming projection.

3. The key blank of claim 2 wherein said camming projection is elongated in the longitudinal direction of said blade.

4. The key blank of claim 3 wherein said recess has a size and shape which is complementary to the size and shape of said projection.

5. The key blank of claim 2 wherein said recess has a size and shape which is complementary to the size and shape of said projection.

6. A key blank, said key blank being configured for use as a key for a cooperating cylinder lock after bitting in accordance with the lock combination, the cylinder lock having a keyway with an irregular cross-section, said key blank comprising:

a bow;

a blade longitudinally extending from said bow and terminating at a blade tip, said blade having first and second spatially displaced side faces and a pair of oppositely disposed and spaced edges which interconnects its side faces, said blade having a thickness measured between said side faces, said blade having a pre-selected profile when viewed in cross-section, said profile being defined by variations in said blade thickness and being at least in part complementary to the cross-sectional shape of the keyway of the cooperating cylinder lock whereby said blade may be substantially fully inserted in the keyway of the cooperating cylinder lock, said blade profile being determined by the removal of material from elongated regions of said side faces which extend longitudinally from said tip and parallely to said edges, portions of said side faces from which material is not removed defining a pair of parallel planes;

at least a first three dimensional projection extending outwardly from a first of said blade side faces beyond the one of said parallel planes defined by said first of said blade side faces, the surface of said projection which faces in the direction of said blade tip being longitudinally displaced from said tip and being adapted to drivingly engage a cam follower which extends into the keyway of the cooperating cylinder lock whereby said projection can function as a cam in response to longitudinal movement of said blade during insertion thereof into the keyway of the cooperating cylinder lock; and an indentation in the second of said blade side faces, said indentation being at least in part in registration with said projection.

7. The key blank of claim 6 wherein said projection is elongated in the longitudinal direction of said blade.

8. The key blank of claim 7 wherein said indentation has a shape which is generally complementary to that of said projection.

9. The key blank of claim 6 wherein said indentation is generally complementary in shape with said projection.

* * * * *